US008104642B2

(12) United States Patent
Bambrick et al.

(10) Patent No.: US 8,104,642 B2
(45) Date of Patent: Jan. 31, 2012

(54) BEVERAGE DISPENSER AND METHOD

(75) Inventors: Timothy C. Bambrick, Fortitude Valley (AU); Richard H. Bloomfield, Iluka (AU)

(73) Assignee: Quikshot Packaging Pty Ltd, Toowong (AU)

( * ) Notice: Subject to any disclaimer, the term of this patent is extended or adjusted under 35 U.S.C. 154(b) by 1093 days.

(21) Appl. No.: 11/574,476

(22) PCT Filed: Aug. 31, 2005

(86) PCT No.: PCT/AU2005/001320

§ 371 (c)(1),
(2), (4) Date: Jul. 2, 2007

(87) PCT Pub. No.: WO2006/024094

PCT Pub. Date: Mar. 9, 2006

(65) Prior Publication Data

US 2009/0272759 A1 Nov. 5, 2009

(30) Foreign Application Priority Data

Aug. 31, 2004 (AU) ..... 2004904948

(51) Int. Cl.
*B67D 1/00* (2006.01)
*B67D 7/70* (2010.01)

(52) U.S. Cl. ..... 222/82; 222/85; 222/132; 222/137; 222/153.04; 222/83

(58) Field of Classification Search ..... 222/81, 222/82, 83, 84, 85, 86, 87, 132, 135, 137, 222/147, 153.04
See application file for complete search history.

(56) References Cited

U.S. PATENT DOCUMENTS

| | | | | | |
|---|---|---|---|---|---|
| 103,453 | A | * | 5/1870 | Hamilton | 222/135 |
| 2,168,686 | A | * | 8/1939 | Saffir | 604/415 |
| 3,311,265 | A | * | 3/1967 | Creighton, Jr. et al. | 222/137 |
| 3,767,085 | A | * | 10/1973 | Cannon et al. | 222/82 |
| 4,119,244 | A | * | 10/1978 | Funke | 222/400.8 |
| 4,299,329 | A | * | 11/1981 | Keiji | 220/276 |
| 4,560,352 | A | * | 12/1985 | Neumeister et al. | 433/90 |
| 4,913,553 | A | * | 4/1990 | Falco | 366/129 |
| 4,915,695 | A | * | 4/1990 | Koobs | 604/191 |
| 5,065,906 | A | * | 11/1991 | Maeder | 222/137 |
| 5,249,709 | A | * | 10/1993 | Duckworth et al. | 222/137 |
| 5,253,785 | A | * | 10/1993 | Haber et al. | 222/43 |
| 5,335,827 | A | * | 8/1994 | Gentile | 222/137 |
| 5,370,273 | A | * | 12/1994 | Rohloff et al. | 222/132 |
| 5,593,066 | A | * | 1/1997 | Konuma et al. | 222/94 |

(Continued)

FOREIGN PATENT DOCUMENTS

AU A-57368/98 9/1998

(Continued)

*Primary Examiner* — Kevin P Shaver
*Assistant Examiner* — Daniel R Shearer
(74) *Attorney, Agent, or Firm* — Hahn & Voight PLLC; Roger C. Hahn

(57) ABSTRACT

A beverage container (10) is disclosed having an outer housing (11), a discharge nozzle (12), one or more beverage chamber (18) and a plunger means that may be a base cup (14) with shaft members (50). Preferably there are two or three beverage chambers. The beverage container (10) may include a mixing nozzle (75). The device may include positioning for a travel position, initial discharge position and fully discharged position. The beverage chambers (18) may be separately filled and held in position by a sleeve (62) frangible seals and a safety cap may be included. The invention extends to a method of providing a beverage, preferably an alcoholic beverage to a consumer.

13 Claims, 10 Drawing Sheets

U.S. PATENT DOCUMENTS

| | | | | |
|---|---|---|---|---|
| 5,873,490 | A | 2/1999 | Walpole | |
| 5,967,373 | A * | 10/1999 | Seager et al. | 222/137 |
| 6,129,244 | A | 10/2000 | Horth | |
| 6,382,466 | B1 * | 5/2002 | Schneider et al. | 222/137 |
| 6,554,165 | B2 * | 4/2003 | Cote | 222/129.1 |
| 6,672,341 | B2 * | 1/2004 | Bartholomew et al. | 141/18 |
| 6,874,657 | B2 * | 4/2005 | Metzner et al. | 222/82 |
| 2003/0008031 | A1 | 1/2003 | Feldman | |

FOREIGN PATENT DOCUMENTS

| | | | |
|---|---|---|---|
| GB | 2245030 | A | 12/1991 |
| JP | 2002-145360 | | 5/2002 |
| WO | WO 94/14680 | | 7/1994 |
| WO | WO 2004/067386 | A2 | 8/2004 |

* cited by examiner

BEVERAGE DISPENSER AND METHOD

FIELD OF THE INVENTION

THIS INVENTION relates to a device and method for storing and dispensing beverages. Preferably, but not exclusively, the invention relates to a device and method for storing a single type of drink or two or more separated ingredients of a final mixed drink. The drink is preferably alcoholic but is not so limited. The drink may be liquid but the invention may also extend to at least one paste. The invention may be adapted to resist tampering by unauthorised parties.

BACKGROUND OF THE INVENTION

Throughout recorded history, it has been a standard process for consumers to enter a public house, bar, restaurant or similar and order one or more drinks, usually with an alcoholic content. Typically, those drinks are dispensed from a bulk storage container, such as a large bottle, into an open drinking glass. This process has at least some chance of contamination of the bulk storage material with consequent risk to subsequent users.

A further risk has more recently evolved relating to the danger of "drink spiking". This term describes activities whereby psychoactive and, often, stupefying chemicals are surreptitiously added to a drink or drinks in a public place, often with an associated intention to rob or assault the victim. Rohypnol® is one notorious example of a drug abused by criminals in this fashion.

This manual preparation, particularly of mixed drinks, has some inherent disadvantages. The bulk container is somewhat clumsy to use. A bar attendant needs considerable skill to know and accurately mix ingredients. This takes time which is an additional cost to a proprietor. Inaccurate mixing may lead to wastage of ingredients or short changing of a client. It may be difficult to identify and mix ingredients in a dark environment such as is present in many nightclubs. Glasses especially shot glasses, may be easily stolen or broken or spilled.

There are other instances where separate storage of components in a final consumable mixture is desirable. For example, some therapeutic agents may be provided in two separate portions that are unstable once mixed.

It would be advantageous to provide a beverage, preferably a multi-ingredient beverage, in an easily used and perhaps disposable container that stored sufficient material for one or a few recipients.

Reference to any prior art in this specification is not, and should not be taken as, an acknowledgement or any form of suggestion that this prior art forms part of the common general knowledge in any country.

SUMMARY OF THE INVENTION

Throughout this specification, unless the context requires otherwise, the word "comprise", or variations such as "comprises" or "comprising", will be understood to imply the inclusion of a stated element or integer or group of elements or integers but not the exclusion of any other element or integer or group of elements or integers.

In a first aspect, the invention resides in a beverage container comprising an outer housing:

a discharge aperture in the outer housing;

one or more beverage storage chambers located in the outer housing;

a discharge outlet formed in each beverage storage chamber to provide an outlet for beverage stored therein. The discharge outlet in fluid communication with the discharge aperture; and plunger means adapted for manual operation to discharge beverage from each beverage storage container through the discharge outlet and discharge aperture.

The beverage storage chambers are preferably formed with a rigid side wall or walls. Alternatively, the side wall or walls may be semi-rigid or even pliable.

The beverage container may contain one or more of Vodka, Tequila, Scotch, Rum, Bourbon, Gin, Advocat, Grenadine, Vermouth, Tia Maria, Kahlua (coffee liqueur), Baileys (Irish cream), Midori (melon liqueur), Cointreau (orange liqueur) and Schnapps (butterscotch or peppermint), although it is noted that these are non-limiting examples.

Liquid foods or pastes, medicaments and other ingestible substances may be suitably stored and discharged in similar fashion other products may include drink mixes like soft drinks, milk, cream, juice and water.

The beverage container preferably comprises two or more beverage storage chambers which may be tubular, although not so limited. The storage chambers may be any suitable cross-sectional shape and may be cylindrical. The beverage container may further comprise restraint means for fixing the two or more storage chambers in position relative to each other. Most preferably, the device has three storage chambers. They may be fixed in abutting contact relative to each other. Each of the three beverage containers may be formed substantially as a third of a circle in cross section, to provide a cylindrical shape when the three beverage storage chambers are aligned for use.

The restraint means may be one or more sleeves adapted to encircle the storage chambers and fix them in position relative to each other, preferably adjacent. Each sleeve may be adhesive and/or elastic.

Restraint means may further alternatively comprise or include a clip arrangement, a channel and rail arrangement or the use of adhesive to fix the storage chambers in position relative each other, preferably adjacent.

The discharge outlet may be a nozzle formed at one end of each of the beverage storage chambers. Each of the discharge nozzles may communicate with a mixing nozzle adapted to mix and discharge the contents of each of the beverage storage containers for consumption. The mixing nozzle may be located in the external housing. Alternatively, the beverage storage chambers may each be adapted to discharge independently. It is preferred that each of the beverage storage chambers contains a different beverage to provide a final mixed drinks or sequence of drinks for consumption. This is not essential however as different storage chambers may have the same beverage if preferred.

The plunger means may comprise a separate plunger arrangement on each of the beverage storage chambers. Two or more plunger arrangements may be inter-engaged for simultaneous operation and may include a thumb tab. Alternatively, each plunger arrangement may be adapted for independent operation. Alternatively, a plunger array may be formed with each plunger formed integrally with or engaged with a rigid support structure for simultaneous operation. Further alternatively, the plunger means may comprise a single plunger adapted to simultaneously discharge two or more liquid storage chambers.

In an alternative embodiment, the plunger means may comprise a semi-rigid or pliable side wall adapted for manual compression by a user to discharge the contents.

Each beverage storage chamber may include an anterior and/or posterior seal to contain the beverage stored therein. Displacement or pressurisation of the storage chamber may lead to rupture the anterior and posterior seal and subsequent discharge of liquid from the chamber as the plunger arrangement is depressed.

The device may be formed from any suitable material but it is preferred if it is formed from thermo-plastic polymers such as Polyethylene, Polyethylene Terephthalate ("PET"), Polystyrene ("PS"), Polypropylene ("PP") or Polycarbonate ("PC") or other material which is suitable food grade. Preferably, the beverage container or components thereof are formed from injection moulding, blow moulding or compression moulding.

The beverage storage container may have a rigid wall or walls. Alternatively, the wall or walls may be semi-rigid or even pliable.

The plunger means may include severing means for severing a band or sleeve holding the chambers in relative position. The band or sleeve may be adhesive.

In a second aspect, the invention resides in a beverage container comprising:

an outer housing comprising a continuous outer wall forming a cavity;

a discharge nozzle, preferably a mixing nozzle, located at one end of the cavity, the other end of the cavity forming an opening;

one or more beverage storage chambers positioned in the cavity, each beverage storage chamber having an outlet in fluid communication with the nozzle;

a plunger arrangement adapted to discharge the contents of the one or more beverage storage chambers on manual operation, the plunger arrangement formed as a rigid cup locatable through the opening and slidable relative thereto, the cup including a plunger or part thereof, for each of the one or more beverage storage chambers.

The beverage container preferably has two or three beverage storage chambers, fixed in relative position, which may be in a longitudinally abutting arrangement. A sleeve, adhesive and/or elastic, may encircle the beverage storage chambers to fix them in position relative to each other. The storage chambers may contain ingredients for an alcoholic drink.

One or more frangible seals may be formed on the beverage storage chambers to resist tampering and/or maintain the integrity of the beverage stored there. Preferably, there is an anterior and posterior frangible seal on each beverage storage chamber. The frangible seal or seals may be adapted to rupture during discharge of the contents of the beverage storage chambers.

The beverage container may include guide means to guide the relative movement of the housing and the plunger arrangement. The guide means may comprise channels, rails for meeting engagement to the channels and/or tabs.

In a further aspect, the invention may reside in or method of providing a beverage, preferably an alcoholic beverage, in a beverage container, preferably for single use, comprising the steps of:

filling one or more beverage storage chambers with an appropriate beverage;

sealing the one or more chambers;

mounting discharge means to discharge the contents of the one or more beverage storage chambers;

The method preferably further comprises the step of fixing two or more beverage storage chambers adjacent to each other.

Forming discharge means may comprise mounting a plunger arrangement to each beverage storage chamber wherein the plunger arrangement is adapted to discharge the contents of the beverage storage chambers when depressed.

Alternatively, forming discharge means may comprise forming the one or more liquid storage chambers with a manually compressible wall or walls, wherein application of sufficient pressure by a user will discharge the contents. Two or more liquid storage chambers with semi-rigid or pliable walls may separately but simultaneously engaged with a single discharge nozzle. Alternatively, two or more liquid storage chambers may be located within a common wall or walls and adapted for discharge through a single pathway to a discharge nozzle.

The method may include the steps of providing a safety cap for the discharge nozzle or nozzles and/or wrapping the beverage storage chamber in a wrap such as a plastic wrap.

The method preferably comprises storing two or more different and compatible liquids each in a respective beverage storage chamber, fixing the two or more beverage storage chambers in relative positions each to the other and mounting plunger means in position to discharge each of the beverage storage chambers during operation.

The method may further comprise the step of mounting a mixing nozzle to outlet apertures of the beverage storage chamber or chambers. The method may still further comprise the step of locating the beverage storage chambers in an external housing and preferably providing rotation resistant means such as guide tracks or lugs to fix the chambers in position inside the external housing.

The method may further comprise providing one or more tamper resistant arrangements on the beverage container. The tamper resistant arrangements may be one or more frangible seals, a safety cap and plastic wrapping.

The method may further comprise the step of colour coding beverage containers to indicate different beverages contained therein.

In yet a further aspect, the invention may reside in a method of providing a drink to a consumer, the method comprising the steps of providing a comestible liquid in a beverage storage chamber and operating a plunger arrangement to discharge the liquid from the container and into a drinking vessel or the mouth of the consumer. The method preferably further comprises the step of storing two or more compatible liquids in respective chambers and operating a plunger arrangement to discharge both liquids into a common receptacle such as a glass or the mouth of the consumer. The method may further comprise the step of charging the consumer for the drink.

BRIEF DESCRIPTION OF THE DRAWINGS

In order to provide a better understanding of the present invention, preferred embodiments will be described in detail, by way of example only, with reference to the accompanying drawings in which.

DETAILED DESCRIPTION OF THE DRAWINGS

Figure 1:
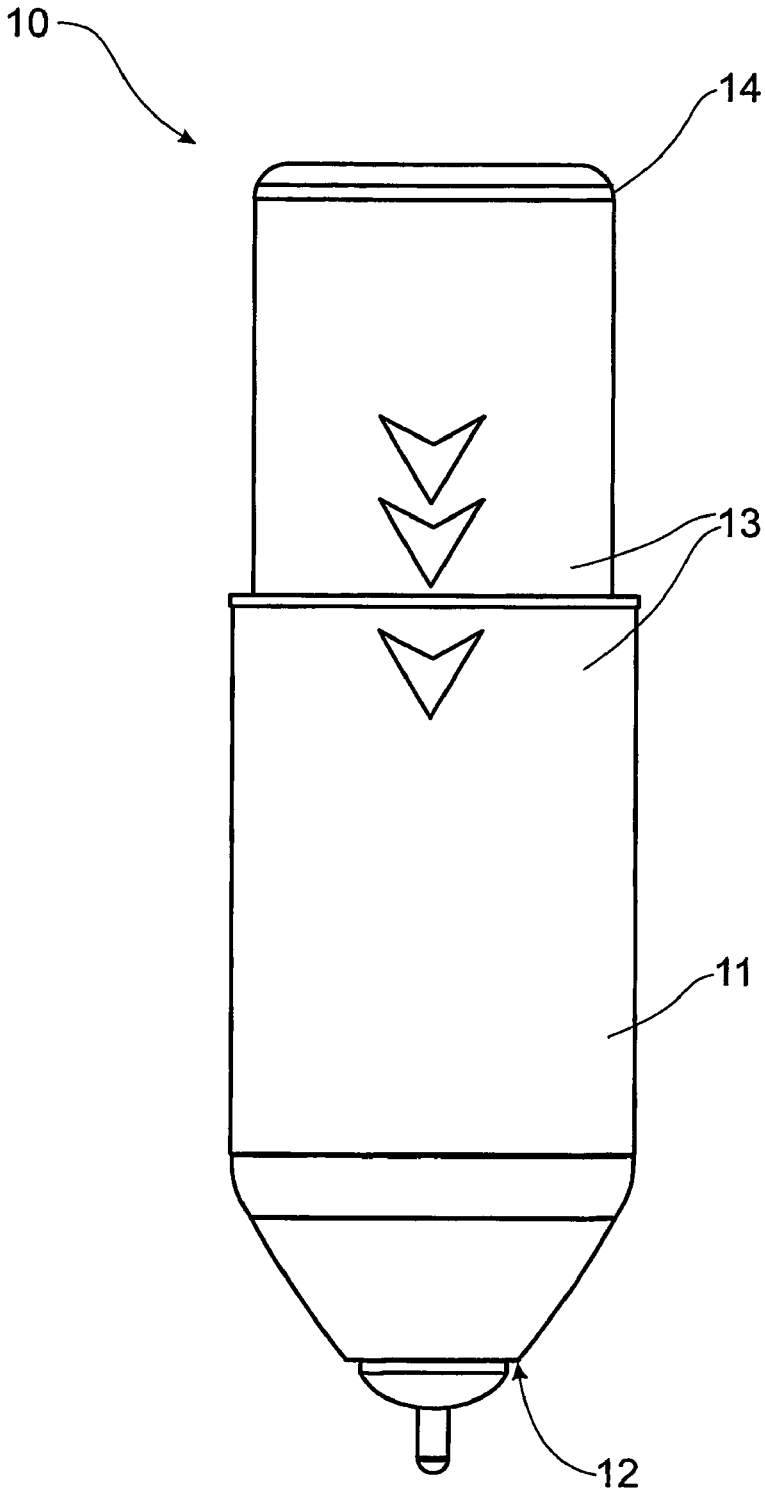
FIG. 1 is a side view of a first embodiment of the present invention.

A first embodiment of a beverage container is shown in FIG. 1. The beverage container 10 comprises an outer housing 11 terminating in a discharge nozzle or aperture 12.

A plunger arrangement in the form of a base cup 14 is positioned internally in the outer housing and adapted for relative sliding movement in relation to the outer housing 11. Arrows 13 are provided as visible indicia to assist in alignment of the outer housing 11 and base cup 14. This process may be further assisted by making arrangements such as a channel and rail as described below.

Figure 2:
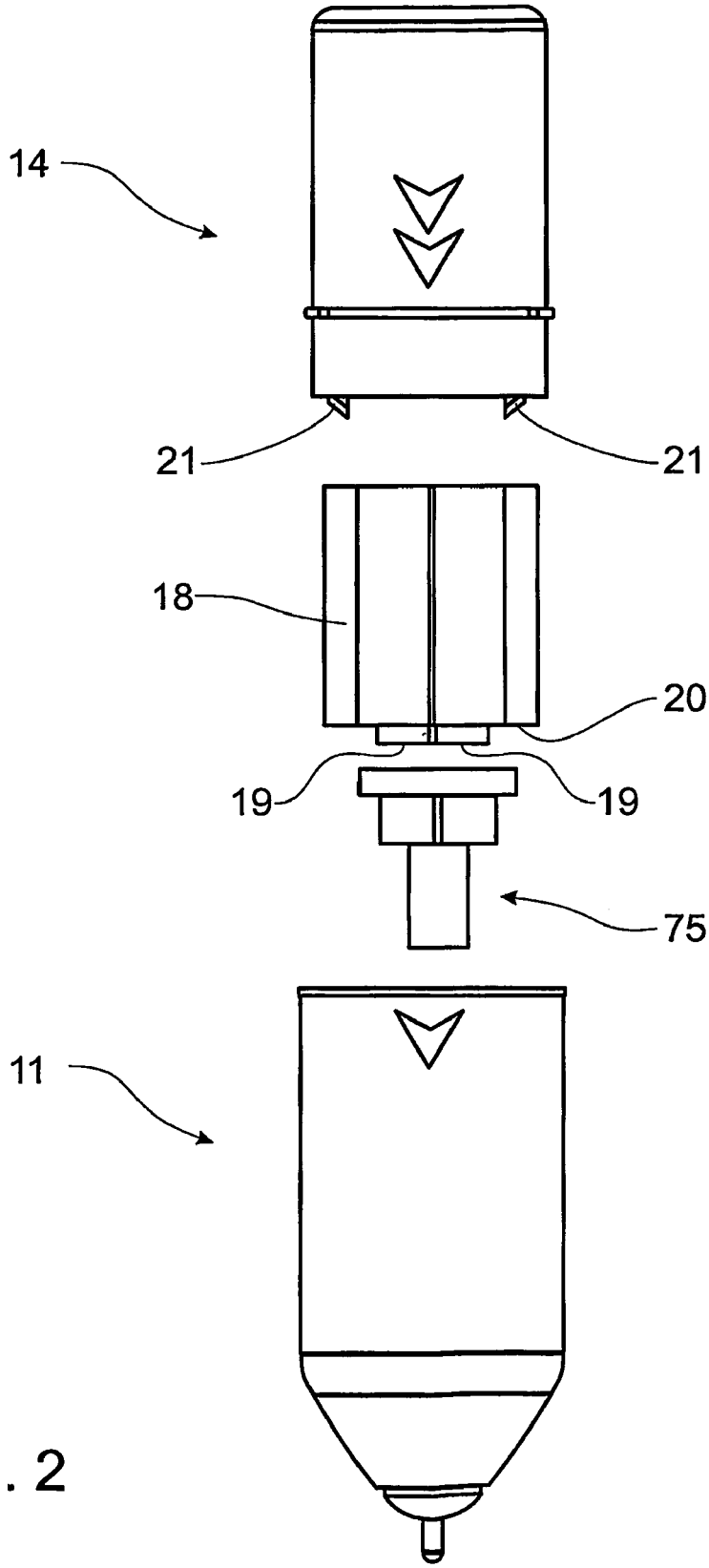
FIG. 2 is an exploded view of the components of FIG. 1.

FIG. 2 shows components of the embodiment of FIG. 1 when separated prior to assembly. The outer housing 11 may be around 105 mm long and 45 mm in diameter. Dimensions may clearly be varied as appropriate for different applications. A directional rail engagable with a channel may be provided to guide the relative movement of the housing 11 and base cup 14. Multiple directional rails and corresponding channels may be provided to enhance smooth operation. Simple lugs may be used instead of rails, adapted to run in the corresponding channel.

The plunger arrangement is provided in the form of base cup 14 which has elongate shafts which are designed to engage a sliding sealing member in the beverage storage chamber (as described further below) and thereby form a plunger arrangement to discharge the contents of the beverage storage containers. Cutters 21 are provided to slice a restraint band as described below Two of three beverage storage chambers 18 are shown and are formed with an elongate tubular shape. The beverage chambers 18 terminate in a discharge aperture or nozzle 19. In one embodiment, the aperture may simply by formed in end wall 20 of the beverage chamber 18 and be flush with the rest of the wall. The aperture may occupy the entirety of the wall space. The chamber may be formed in any suitable configuration that permits effective operation of a plunger discharge and can be expected to be tubular. The chamber may be formed with a pliable wall that is compressed by the plunger action.

The components together form the beverage container. Additional features may include a safety cap over the end of the outer housing. Its removal indicates the device has been accessed at least in part. The safety cap may be fixed in place by a rip seal such as is common in soft drink bottles and the like wherein a series of lugs attach the cap to a collar on the other feature on the housing. The lugs break with operation. This is often accomplished by twisting. Finger indents may be provided. The shown embodiment includes a mixing nozzle 75 for mixing contents of the separate chambers.

Figure 3:
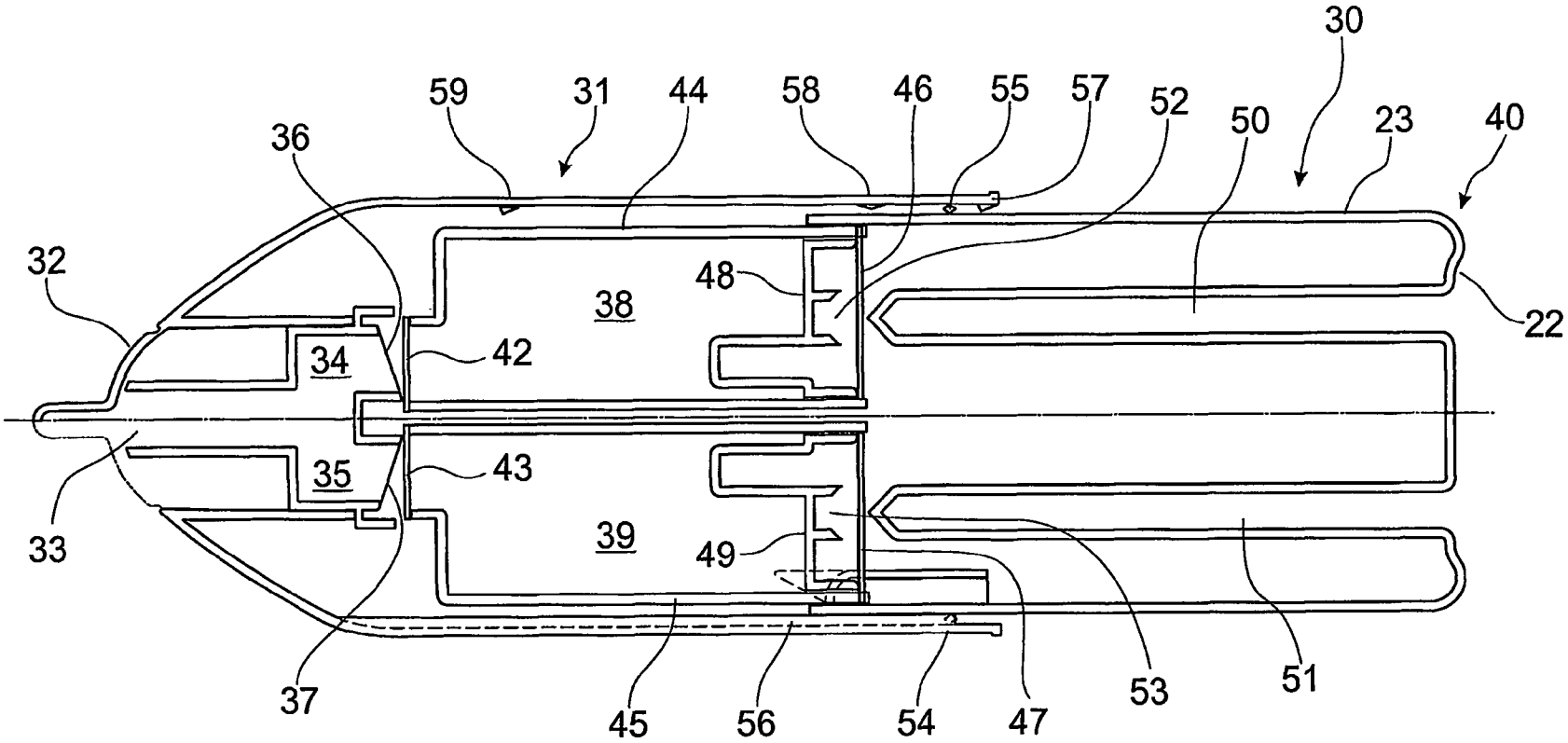
FIG. 3 is a side section view of the arrangement of FIG. 1.

FIG. 3 is a side sectional view of a beverage container 30 with an outer housing 31 positioned around beverage storage chambers 38, 39 and a plunger arrangement including end cup 40. The outer housing 31 has a discharge nozzle 32 which communicates through primary outlet 33 to secondary conduits 34, 35, each of which terminate in a beveled and/or sharpened edge 36, 37, respectively. The primary outlet 33 and secondary conduits 34, 35 form a mixing nozzle for mixing the contents.

The edges 36, 37 are aligned with outlet nozzles 42, 43, respectively, which, in this case, are covered by a frangible seal adapted to rupture under sufficient pressure or on pressurised contact with edges 36, 37. Beverage storage chambers 38, 39 each have a continuous side wall 44, 45 and are sealed by a second frangible seal 46, 47, respectively. One particularly suitable material is foil type seals as are well known in the field. A wall or divider 48, 49, is slidably mounted in each of the liquid chambers 38, 39.

The base cup 40 has two visible shaft members 50, 51 supported by a rigid base 22 and side wall 23. The shaft members 50, 51 are aligned with seats 52, 53 respectively, formed in walls 48, 49.

The base cup 40 has nibs 54, 55. Each nib 55 is aligned to run along a corresponding one of equally spaced base cup location rails 56 to control the positioning of the base cup 40 relative to the outer housing 31 and hence to the beverage storage chambers 38, 39. Lugs 57 are provided to retain the base cup 40 in the outer housing 31. When the base cup is advanced in operation, the nib 55 meets a second lug 58 which indicates the end of the first stage of operation. Finally, in operation, a terminal lug 59 is provided to indicate completion of depression of the base cup 40 and to lock the plunger cup array in a depressed position thereby avoiding or resisting re-use.

In one embodiment, the present invention has three stages of operation.

The travel or locked stage—this is to prevent the unit from being accidentally compressed during transit or storage. The unit must then be rotated to allow channels in the base cup to align with location rails, at which point the unit may be advanced to the next stage.

The ready or loaded stage—at this point the unit has been compressed somewhat and both rear and exterior seals have been pierced (a requirement of some liquor licensing authorities preventing the sale of takeaway liquor (i.e. unopened) over the bar by holders of a general liquor license). This is the point at which the bartender may hand the unit to the purchaser or consumer. The consumer may then remove a non-sealing safety cap and compress the unit to the final stage, consuming the discharged liquid with confidence that it has not been tampered with.

The compressed or used stage—this stage locks off (using a lock tab) the compression function so that the plungers remain in place and can not be refilled by drawing back other liquid. Used units may be easily identified by bar staff for disposal.

Figure 4:
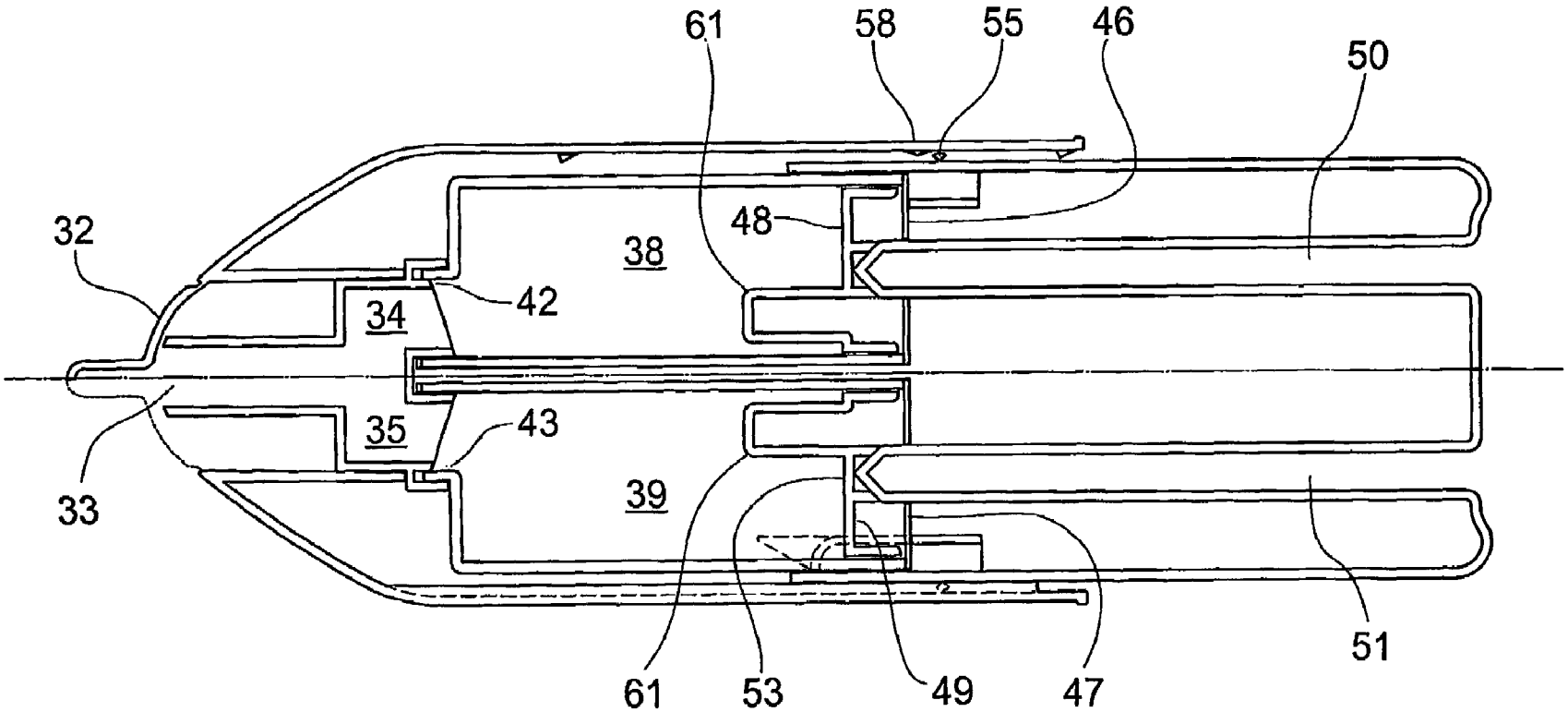
FIG. 4 shows the view of FIG. 3 at initiation of discharge.

FIG. 4. shows the arrangement of FIG. 3 wherein the plunger is manually depressed to a first stage operation. The shaft members 50, 51 have penetrated the seals 46, 47 and engage seats, 52 53 of the walls 48, 49. The shafts and walls now form a plunger for each of the beverage chambers. In an alternative embodiment, the shafts may be permanently attached and even integrally formed with the walls. The nib 55 is in abutting contact with the lug 58, thereby indicating to an operator that the first stage is complete. Depression of the base cup 40 leads to displacement of the liquid containers 38, 39 towards the outlet nozzle 32, thereby causing the outlet chamber nozzles 42, 43 to slide over the secondary outlets 34, 35 and rupture the frangible seals. The liquid in the beverage chambers 38, 39 is now in liquid communication with the outlet nozzle 32 which includes a discharge aperture.

Figure 5:
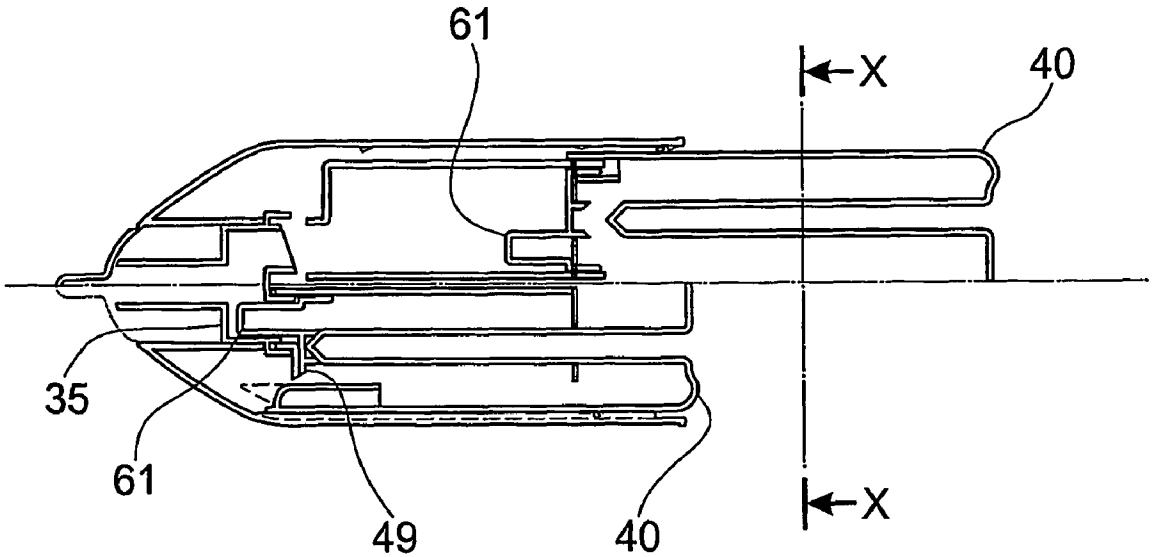
FIG. 5 is a side section view of the embodiment of FIG. 3 with one chamber discharged.

In FIG. 5. the lower half of the side section view shows the base cup 40 advanced to full depression. The wall 49 has been urged down so that an extension section 61 fully occupies secondary outlet 35 and discharges all fluid from the beverage chamber 38. This view shows a sectional and comparative operation of the two plungers. In fact, this embodiment could only result in simultaneous position of the plungers between the transport and used position. However, it should be understood that independent operation of the plungers is possible in a different embodiment and may be desirable in certain circumstances. In one of the simplest embodiments, there may be provided two or more coupled syringe-like arrangements containing consumable liquid.

Figure 6:
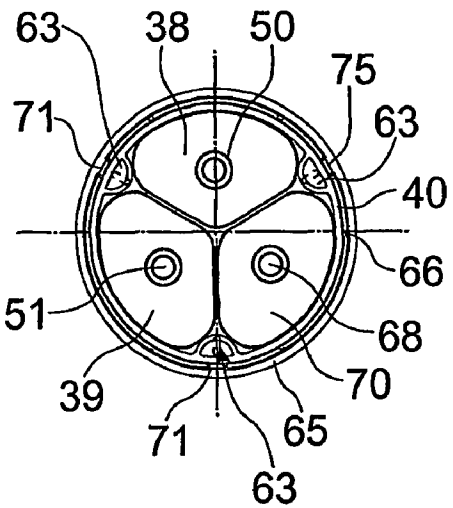
FIG. 6 is a sectional view of the embodiment of FIG. 5 taken through the line XX.

FIG. 6. is a transverse sectional view along line XX of FIG. 5. looking towards the outer housing and shows three shafts 50, 51, 68 which are connected with base cup 40. The shafts are aligned with the beverage storage chambers 38, 39, 70 which are shown in abutting contact and positioned by container location rails 63. The base cup 40 is positioned in relation to the outer housing 31 by three base cup location rails 71 and lugs 65, 66 are also apparent. In loading the outer housing 40, the liquid chambers 38, 39 70 are bound together by adhesive wrap 62 to form a sleeve and then rotated around to position them equally in relation to the inner rails 63. The base cup is then urged into position past the first lugs 57 to retain the end cap in relative position. The whole device may be wrapped in a plastic outer layer, such as shrink wrap sleeve, and, or alternatively, a cap may be provided to cover the nozzle 32. This provides additional security during transport as well as indicating to the end-user that the device has not been tampered with. It is envisaged that each of the liquid chambers 38, 39, 70 may be filled with a different mixer such as a spirit, liqueur or flavoring agent. The end cap may be adapted for simultaneous discharge of components through the mixing nozzle 32 and direct delivery to the mouth of a user or into a drinking vessel such as a cup. Alternatively, the plunger arrangements may be separably operable for a drink such as a Black Russian where a layer of Tia Maria or Kahlua or other dark liqueur may be first discharged into a glass followed by a top layer of Vodka followed by some form of mixer such as lemon or lime juice. The device has obvious application to non-alcoholic drinks as well and palatable gels or pastes may also be stored for consumption. One or more components may be a paste. The device may be suitable for therapeutic agents such as antibiotics or vitamins. It is particularly suitable for two (or more) component drinks where the components are stable when stored separately but the mixture must be consumed shortly after blending. Many consumables may be included in this category.

The location rail may be adapted to form one or more cutters to slice the wrap around adhesive during operation so that the liquid chamber may be advanced relative to its colleagues for initial use when separate action is required. These cutters 21 are shown in FIG. 2. Cutting the band may also allow for differential movement between the containers when discharged simultaneously. The individual chambers may be wrapped to assist them to locate the piercing nozzles. The blades are to cut the wrapper (or label) and may also allow the base cup and location rails to advance towards full compression status (the used stage).

Figure 7A:
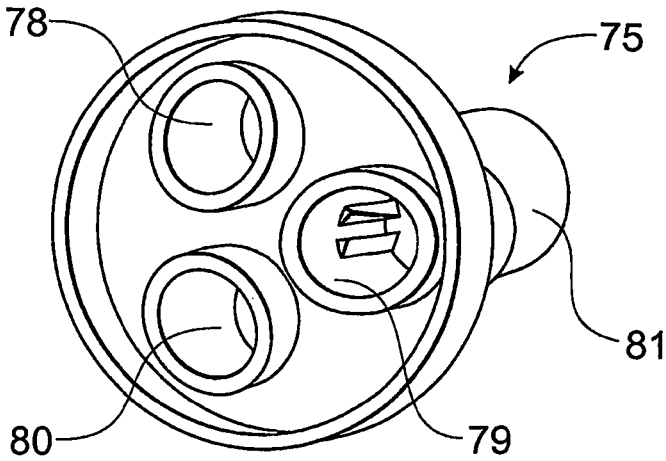
FIG. 7 shows a series of views of a mixing nozzle.
Figure 7B:
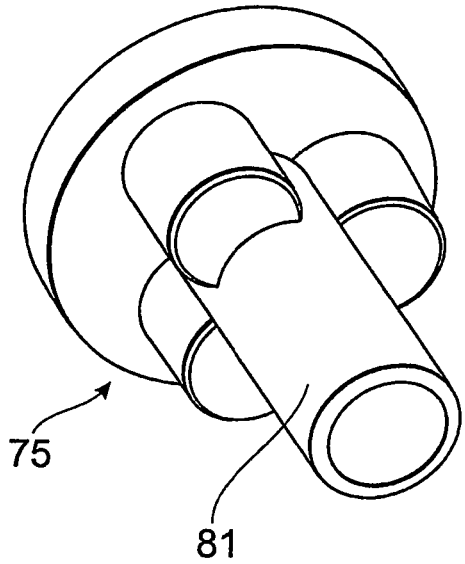
Figure 7C:
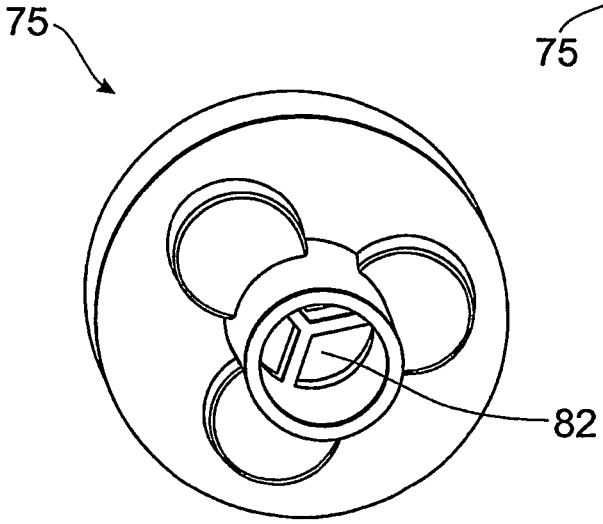
Figure 8:
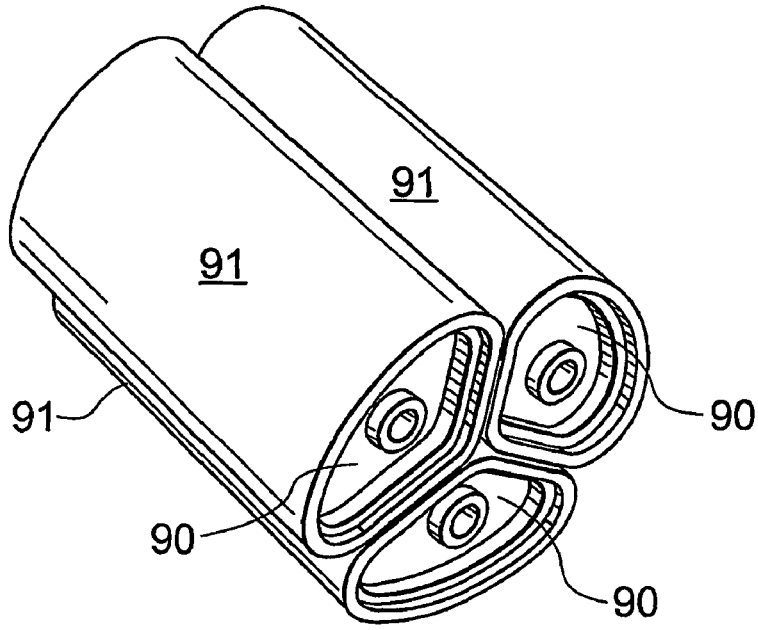
FIG. 8 is a perspective view of three beverage storage chambers in position adjacent to each other.

FIG. 7 shows several views of one embodiment of a mixing nozzle arrangement 75 adapted to provide turbulent flow of the contents through divider 82 and subsequent mixing on discharge through dispensing nozzle 81. The mixing nozzle 75 receives liquid from three different liquid chambers. The mixing nozzle 75 has three spaced recesses 78, 79, 80 adapted to receive corresponding nozzles from each of the three beverage storage chambers. The recesses communicate with outlet nozzle 81 which finally discharges the liquid contents from the device directly or through an outlet aperture in the outer housing In FIG. 8 the dividers or walls 90 are shown in position and slidably movable relative to the beverage storage chambers 91 and in a fluid-tight fashion so that depression and sliding of the dividers or walls 90 will not cause back flow of the contents of the chambers 91.

Figure 9:
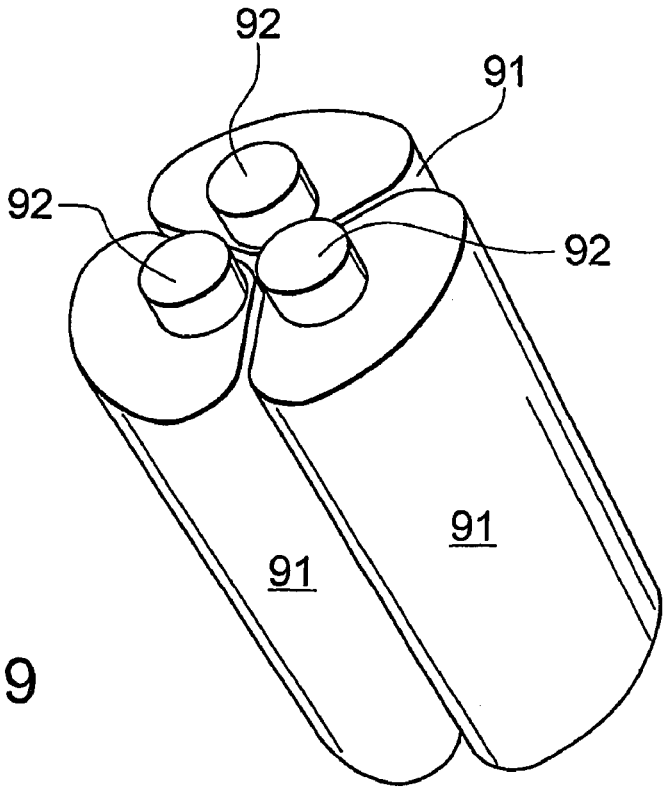
FIG. 9 shows the arrangement of FIG. 8 from a reverse view.
Figure 10:
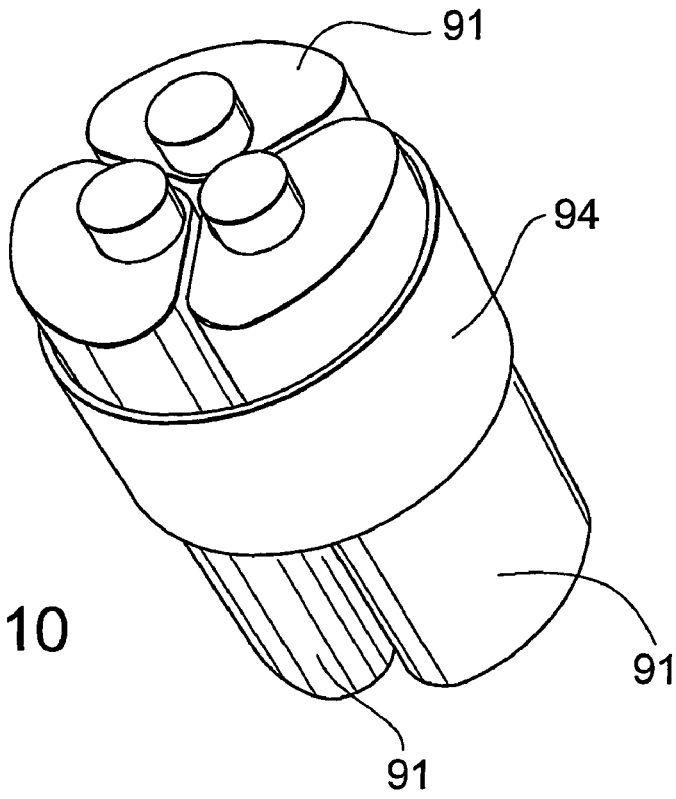
FIG. 10 is an isometric view of the arrangement of FIG. 8 with a restraint band attached.

FIG. 9 shows a reverse view with the outer seals 92 apparent across the discharge nozzles 93 on the storage chambers 91 in FIG. 10 a binding adhesive wrap 94 is apparent and formed as a sleeve to hold the liquid chambers 91 in relative position. The adhesive wrap 94 may be suitably adorned with a trade mark of the manufacturer and provider and also information as to the contents of the container. The band may be adhesive or elastic. Its primary purpose is to hold the separate beverage chambers in position relative to each other adjacent the three chambers each substantial forming one third of a circle so that combined they form a cylinder.

The beverage storage chambers may be formed integrally or in multiple arrangements. In its most basic form, a single liquid chamber may be used for holding a shooter or other drink for solitary consumption or, indeed, for a single volume of a particular ingredient. The single liquid chamber may have a plunger and an outlet. The walls of the beverage storage container may be transparent to allow visualisation of contents. Alternatively or additionally, they may be colour coded to indicate contents. In fact, the whole container may be transparent in whole or in part. The invention may extend to recipes for use with the beverage storage chamber wherein different drinks are formed simply by the addition of indicated coloured containers. The multiple liquid chambers may be held by the adhesive band as discussed. Alternatively, the walls of the chambers may be adapted to inter-engage such as through a slot and rail arrangement, a clip arrangement, or be combined through the use of an adhesive. It is envisaged that one advantage that may arise from separability of the containers is that they may be filled with different ingredients on individual assembly lines and, indeed, in separate locations if preferred. While the description shows the liquid chambers substantially the same in dimension, it is clear to a skilled addressee that variation in the relative volumes of the chambers may be easily accomplished using known manufacturing techniques, should the volume of the components be required at different levels. For example, the cross-sectional area of chambers may be varied and/or the stroke length of the plungers. While three liquid chambers are shown, it is clear that one, two, three, four or more may be used if required, although the manufacturing complexity if the device increases with higher numbers.

Figure 11:
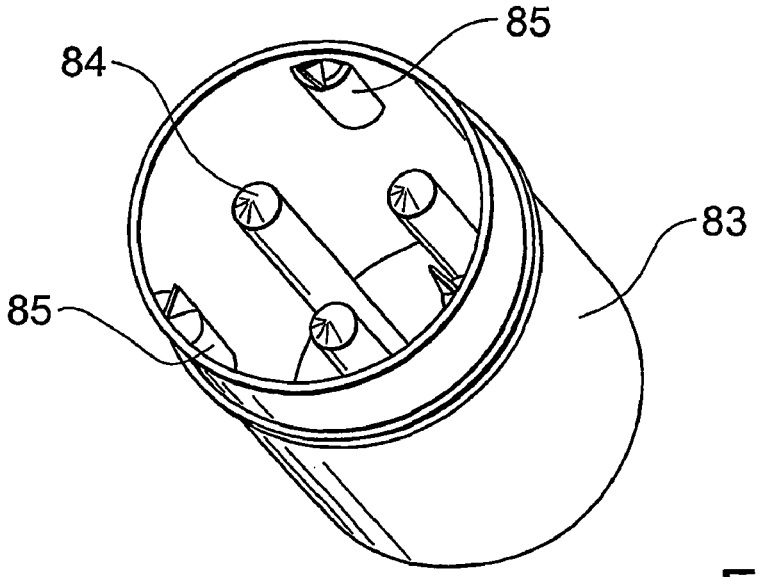
FIG. 11 is a perspective view of a plunger arrangement for use in the present beverage container.

FIG. 11 shows a base cup 83 with three shaft members 84. The pointed ends 86 of the shaft members 84 are readily apparent and better adapted to penetrate the seal and nest in receiving seats. A rail 86 is shown for engagement in a channel in the outer housing to accurately locate the components relative to each other.

Figure 12:
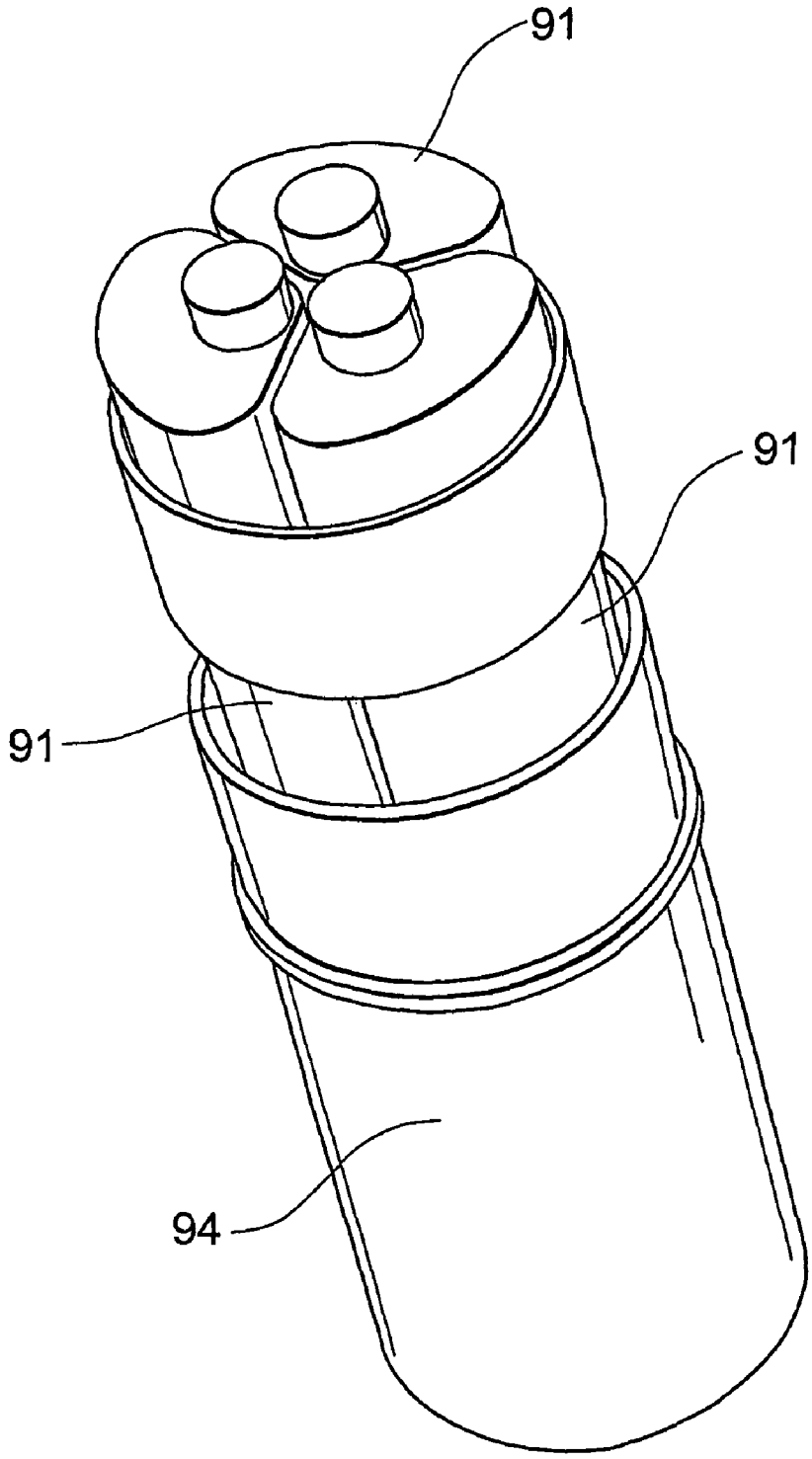
FIG. 12 shows the beverage storage chambers engaged with a plunger arrangement.

FIG. 12 shows an assembly of the beverage storage chambers 91 positioned in the end cup 94.

Figure 13:
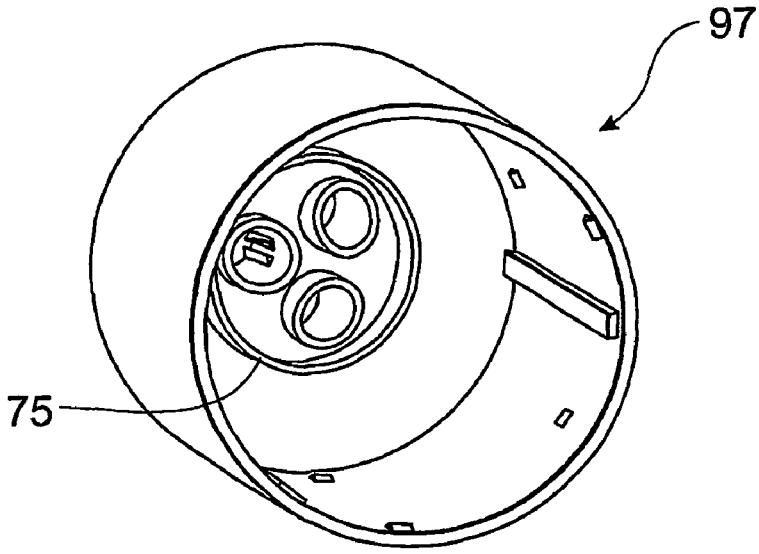
FIG. 13 is an isometric view of an outer housing including a mixing nozzle

An outer housing 97 is further shown in FIG. 13 wherein the mixing nozzle 75 is apparent and in position. The nozzle may be formed separately or integrally as most appropriate in any circumstance. An outlet aperture may be formed as a part of the outlet nozzle in the outer housing with a series of arced slits providing for discharge of the mixed liquids.

Figure 14:
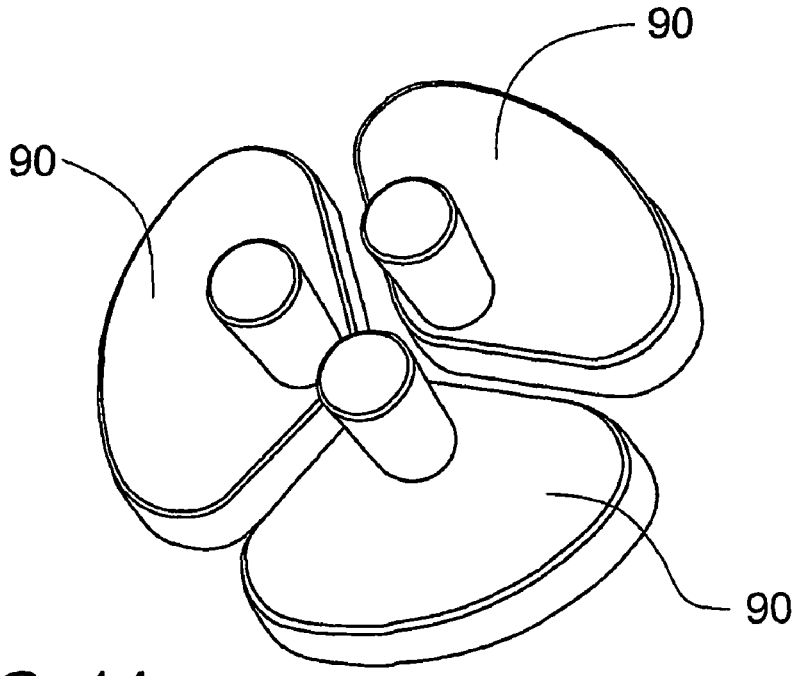
FIG. 14 is a perspective view of sliding walls or dividers for the storage chambers.

FIG. 14 shows three sliding walls or dividers 90 adapted for location via corresponding storage chambers.

While the description of the preferred embodiment is to a device with substantially rigid components, it is clear to a skilled addressee that various alternative configurations may be used. For example, instead of a plunger arrangement, the storage chamber/s and/or housing may be formed as a "squeeze" activated arrangement. Deformable walls, either semi-rigid or even pliable, may be used with discharge through individual nozzles or a common mixing nozzle. The expression "beverage" is use in a broad sense and includes drinks, both "soft" and alcoholic. However, it also includes suitable foods such as broths and similar and extends to any ingestible liquid or semi-liquid material of suitable consistency for use in the device, particularly where components need separate storage. This may include ingestible medications.

The advantages of the present invention include the ability to provide an individual drink or a small number of drinks for immediate discharge and consumption by a consumer. When present, one or more seals provide anti-tampering barriers which allow a consumer to ingest in full confidence that the last person to have access to the liquid was the manufacturer. The present invention also provides a method of sale for the owner of an establishment, wherein individual drinks may be provided. The outer housing may be reusable or may be disposable. It is envisaged that cheap materials, although of a sufficient quality to be of food grade standard, will be used, which may be moulded typically, but not exclusively, from thermo-plastic polymers such as PE, ET, PS, PP, PC by means such as injection moulding, blow moulding, or compression moulding. The manufacture of the device also provides the ability to apply bright and attractive colours to one or more components, thereby enhancing the marketability of the device. In fact, colour coding may be used as a means of indicating the nature of the drink contained in the beverage dispenser. In one simple form, the method of the present invention may extend to pouring a drink preferably alcoholic, in a syringe type arrangement. Preferably the arrangement has a safety cap as previously describe. It may also or alternatively be wrapped to prevent tampering.

In one preferred embodiment, the chambers are formed separately. They may then be filled at different locations and ultimately assembled elsewhere. Retention of the chambers may be via a band, rail or lug and corresponding channel connection arrangement, gluing, clips or other suitable means to a skilled adhesive. The beverage storage chambers may be formed as a kit for assembly when required.

Suitable seals may be formed from foil which may be ultrasonically welded to the tip of the base and top apertures or orifices of the beverage storage chambers.

The present invention has a number of advantages in a bar setting including:

ease of bartender use
eliminates need for staff to remember shot recipes;
elements preparation time;
vertical layer viewing, yet mixed completely on discharge;
alcohol wastage eliminated;
no bartender stock control errors;
product sold=product purchased=0% wastage;
better stock control—means no free drinks;
recyclable packaging—environmentally friendly;
very commercially marketable and promotable;
health, safety and liability concerns reduced;
increased shooter sales for nightclubs and bars;
expands the shot market—out or at home;
reduce costs—no shot glasses required;

Throughout the specification, the aim has been to describe the preferred embodiments of the invention without limiting the invention to any one embodiment or specific collection of features. Those of skill in the art will therefore appreciate that, in light of the instant disclosure, various modifications and changes can be made in the particular embodiments exemplified without departing from the scope of the present invention. All such modifications and changes are intended to be included within the scope of disclosures.

The invention claimed is:

1. A beverage container for storing and dispensing a beverage, the beverage container comprising:

an outer housing, said outer housing comprising a continuous outer wall forming a cavity, a first end of the cavity formed as an opening;

a discharge nozzle in the outer housing and located at a second end of the cavity;

a mixing nozzle positioned in the outer housing and adapted to mix the beverage for consumption, the mixing nozzle in fluid communication with the discharge nozzle;

two or more beverage storage chambers located in the outer housing, each beverage storage chamber containing a beverage;

a discharge outlet formed in each beverage storage chamber to provide an outlet for the beverage contained therein, the discharge outlet in fluid communication with the discharge nozzle;

plunger means adapted for manual operation to discharge beverage from each beverage storage chamber through each discharge outlet and the discharge nozzle, the plunger means comprising a separate plunger arrangement for each of the two or more beverage storage chambers, the separate plunger arrangements inter-engaged by being formed integrally with or engaged with a rigid support structure for simultaneous operation, the rigid support structure formed as a rigid cup locatable through the opening and slidable relative thereto for simultaneous operation;

each separate plunger arrangement comprising an elongate shaft member and a corresponding sliding wall or divider mounted in a respective beverage storage chamber, each elongate shaft member alignable with the corresponding wall or divider, the shaft member adapted to engage the corresponding sliding wall or divider on depression of the plunger arrangement;

an anterior seal on the discharge outlet of each of the two or more beverage storage chambers, the anterior seal adapted for rupture as the plunger arrangement is depressed;

a posterior seal sealing a rear of each of the two or more beverage storage chambers, the posterior seal positioned between the elongate shaft and corresponding wall or divider, the posterior seal adapted for rupture by a respective elongate shaft on initiation of manual depression of the plunger arrangement, thereby allowing an end of the elongate shaft to engage the sliding wall or divider to form a plunger to discharge the beverage from the corresponding beverage storage chamber;

guide means to guide the relative movement of the housing and the plunger means, the guide means comprising one or more of tracks, rails, and tabs; and positioning means for relative movement between the outer housing and the rigid cup to provide a first travel position, a second initiation position and a third discharged position, wherein movement between the first travel portion and the second initiation position requires rotation of the cup relative to the housing and partial depression of the cup and movement to the third discharged position requires full depression of the cup;

wherein:

the beverage container is dimensioned to be portable, hand-held and is adapted for operation by direct manual depression of the plunger means.

2. The beverage container of claim 1 including three tubular beverage storage chambers fixed in abutting contact relative to each other.

3. The beverage container of claim 1 including three beverage storage chambers wherein each of the three beverage storage chambers is formed substantially as a third of a circle in cross section, providing a substantially cylindrical shape when the three beverage storage chambers are aligned for use.

4. The beverage container of claim 1 including restraint means for fixing the beverage storage chambers in position relative to each other.

5. The beverage container of claim 4 wherein the restraint means is one or more sleeves adapted to encircle the beverage storage chambers and fix them in position relative to each other.

6. The beverage container of claim 4 wherein the restraint means comprises one or more of a clip arrangement, a channel or lug and rail arrangement, and an adhesive to fix the storage chambers in position.

7. The beverage container of claim 1 wherein the mixing nozzle includes two or more spaced recesses each adapted to receive a corresponding outlet nozzle from a beverage storage chamber.

8. The beverage container of claim 5 further comprising severing means for severing the one or more sleeves holding the beverage storage chambers in relative position.

9. The beverage container of claim 1 including two or three beverage storage chambers fixed in relative position each to the other, in a longitudinally abutting arrangement and having a sleeve encircling the beverage storage chambers to fix them in position relative to each other.

10. The beverage storage chamber of claim 1 wherein the third discharged position locks the plunger arrangement to the housing of the beverage container and resists reuse.

11. The beverage container of claim 1 further comprising a secondary conduit for each of the two or more beverage storage chambers, the secondary conduit terminating in a beveled and/or shaped edge adapted to rupture the anterior seal, and wherein the second conduit fully occupies the outlet nozzle after the anterior seal is ruptured.

12. The beverage container of claim 1 wherein each divider or wall includes an extension section adapted to fully occupy a corresponding secondary conduit to discharge all fluid from the corresponding beverage storage chamber.

13. The beverage container of claim 1 wherein the beverage is one or more of alcohol, another ingestible liquid and a medication.

* * * * *